US009750330B2

(12) United States Patent
Baker

(10) Patent No.: US 9,750,330 B2
(45) Date of Patent: Sep. 5, 2017

(54) CARD EXTRACTION APPARATUS

(71) Applicant: Dylan Paul Baker, Murrieta (CA)

(72) Inventor: Dylan Paul Baker, Murrieta (CA)

( * ) Notice: Subject to any disclaimer, the term of this patent is extended or adjusted under 35 U.S.C. 154(b) by 0 days.

(21) Appl. No.: 13/747,185

(22) Filed: Jan. 22, 2013

(65) Prior Publication Data

US 2014/0203581 A1 Jul. 24, 2014

(51) Int. Cl.
*B66F 19/00* (2006.01)
*A45F 5/00* (2006.01)

(52) U.S. Cl.
CPC ..... *A45F 5/00* (2013.01)

(58) Field of Classification Search
USPC ..... 294/212, 219, 27.1; 16/407; 116/234, 116/236, 238, 239; D19/34
See application file for complete search history.

(56) References Cited

U.S. PATENT DOCUMENTS

| | | | | |
|---|---|---|---|---|
| 1,524,399 | A * | 1/1925 | Krueger | 16/407 |
| 3,567,108 | A * | 3/1971 | Corridon | 229/117.23 |
| 3,864,993 | A * | 2/1975 | Hovind | 81/488 |
| 5,876,081 | A * | 3/1999 | Melody et al. | 294/27.1 |
| 6,375,239 | B1 * | 4/2002 | Reed et al. | 294/27.1 |
| 8,434,803 | B1 * | 5/2013 | An | 294/212 |
| 2008/0301910 | A1 * | 12/2008 | Lawrence | 16/407 |
| 2013/0170938 | A1 * | 7/2013 | Lowden | 414/800 |

* cited by examiner

*Primary Examiner* — Saul Rodriguez
*Assistant Examiner* — Gabriela Puig
(74) *Attorney, Agent, or Firm* — Erik Vieira

(57) ABSTRACT

A card extraction apparatus which is useful for removing a card from a card storage device is disclosed. The card extraction apparatus has an affixing element to affix the card to the card extraction apparatus and further has a tab member which a user may grip to apply an extracting force.

3 Claims, 4 Drawing Sheets

101
102
100

106
110
108
104
103
102a
102b
100

106
108
104
102a
102b
100

104
106
108
102a
102b
100

104
106
108

301
304
303
300

312
302
304
300

312
302
306
310
304
300

404
403
400

402
404
403
400

402
406
410
404
403
400

CARD EXTRACTION APPARATUS

BACKGROUND

Field

The present disclosure generally relates to a card extraction apparatus for extracting a card from a card storage apparatus.

Related Art

Worldwide each day millions of financial transactions and identification verifications are conducted using standard sized instruments, such as for example credit cards, driver licenses, debit cards, medical cards, gift cards, health club cards, and customer rewards cards. Safe storage and transportation of these instruments necessitates a compartmentalized card storage apparatus. Typically, a tight slot and sheath is provided in the card storage apparatus, sized appropriately for the standard sized instruments, into which each card is inserted. Once inserted through the slot and into the sheath, a portion of the card protrudes outwardly from the slot, providing a user with the ability to extract the card by gripping the outwardly protruding portion and applying an extracting force. Most people in industrialized nations around the world carry varieties of such card storage apparatuses, such as for example wallets. Indeed, the use of such standard sized financial and identification instruments has rapidly become a necessity for functioning in the industrialized world.

An unfortunate byproduct of such safe storage and transportation devices such as the card storage apparatus is difficultly in extracting the financial or identification instrument at a point in time when such an instrument is necessary to conduct a transaction or identification verification. Because of the importance of securely storing such instruments, the aforementioned slot and sheath tend to be very tight, often making it troublesome for a user to extract the instrument. This problem is further compounded by the fact that identification verification usually occurs simultaneously with a financial transaction, which can require a user to extract two or more cards, depending on the level of verification security required.

Because card storage apparatuses typically are designed such that a user may use her fingers to grip the portion of the instrument protruding above the slot, outwardly of the sheath, the normal method of extraction involves using fingers to apply a force to remove the card. When the sheath and/or slot are too tight to be removed by application of force by fingers, the user has a problem continuing the transaction or identification verification. Current solutions for such a problem are limited. One method involves using hardware for extraction, such as for example a pair of pliers In the modern day, most standard size financial transaction and identification verification cards have magnetic strips containing important, sensitive information. Demagnetization of such magnetic strips can cause delay or in extreme cases failure in the transaction or verification process. Long term exposure to materials lining card storage apparatuses can lead to demagnetization of the magnetic strip, particularly because typically the magnetic strip is disposed upon the back side of such stored cards, which tends to be the side in physical contact with the card storage apparatus.

Many people living in industrialized nations are growingly dependent upon the aforementioned transaction and identification cards and have had the misfortune of misplacing such a card. Of course, realization that such a card has been misplaced often times occur when that particular card is needed. Rapidly locating the misplaced card can be a matter of urgency. It is often the case that such a misplaced card is less than a few feet away from the card storage apparatus, such as for example in a purse, backpack, duffle bag, suitcase, or briefcase.

The present teachings describe apparatuses and methods which allow a user to more safely and easily extract a card from a card storage apparatus than current solutions provide. The present teachings overcome the aforementioned issues associated with current state of the art solutions, as will now be described in greater detail.

SUMMARY

In one embodiment, a card extraction apparatus is disclosed. The card extraction apparatus has a proximate card end and a distal card end and is adapted for facilitating a user extracting a card stored in a card storage apparatus. The card extraction apparatus has an affixing element, disposed at the proximate card end of the card extraction apparatus, wherein the affixing element is adapted to affix the card extraction apparatus to the stored card. The card extraction apparatus also comprises a tab member, disposed at the distal card end of the card extraction apparatus, wherein the tab member has a tab width and a tab length.

BRIEF DESCRIPTION OF THE DRAWINGS

Embodiments of the present disclosure will be more readily understood by reference to the following figures, in which like reference numbers and designations indicate like elements.

DETAILED DESCRIPTION

The present teachings disclose a card extraction apparatus, useful for removing an item from a card storage device.

Figures 1A, 1B, 1C, 1D:
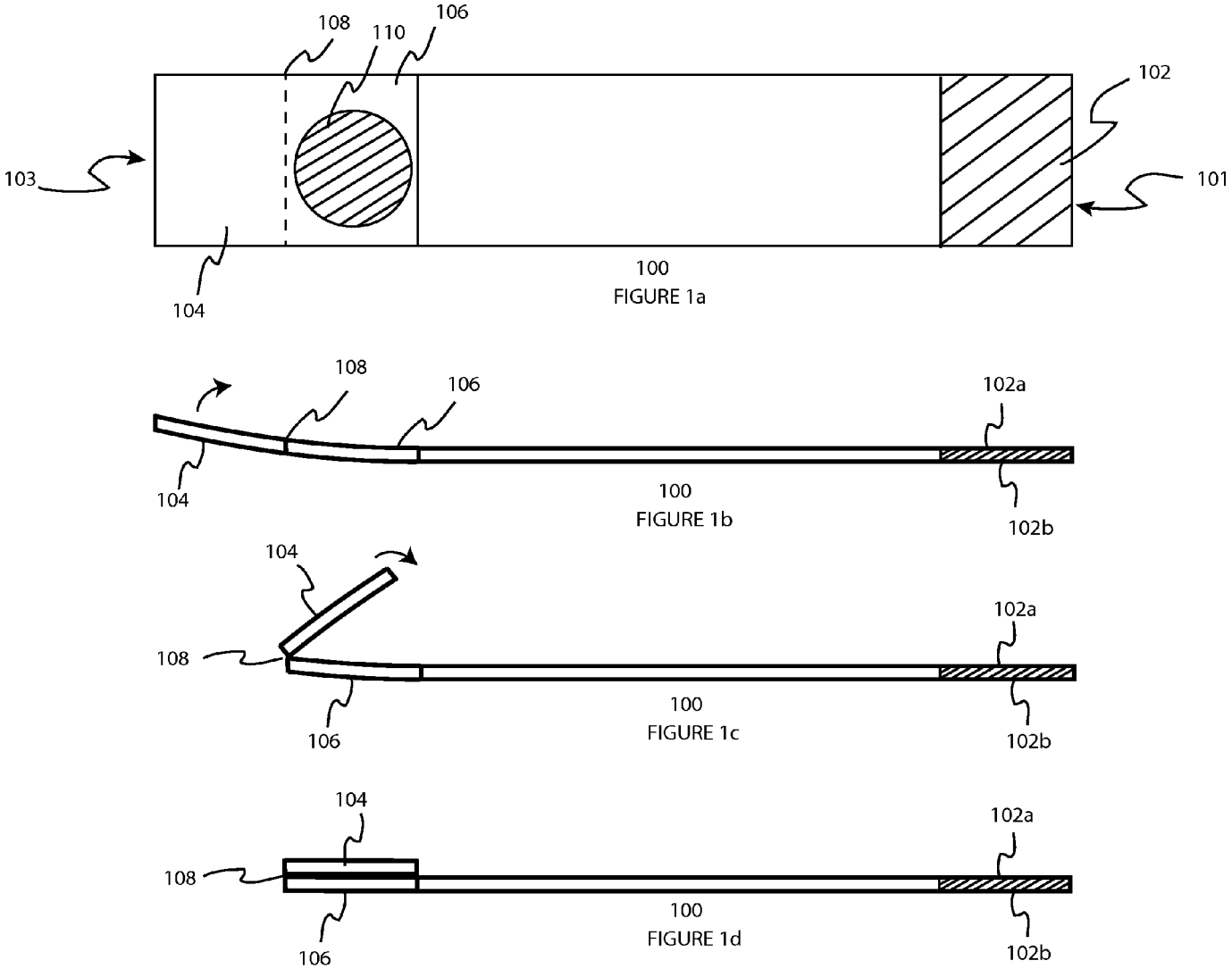
FIG. 1*a* illustrates a top plan view of a card extraction apparatus, according to one embodiment of the present teachings.
FIG. 1*b* illustrates a first side plan view of a card extraction apparatus, according to one embodiment of the present teachings.
FIG. 1*c* illustrates a second side plan view of a card extraction apparatus, according to one embodiment of the present teachings.
FIG. 1*d* illustrates a folded side plan view of a card extraction apparatus in a folded position, according to one embodiment of the present teachings.

Referring now to FIG. 1*a*, FIG. 1*b*, FIG. 1 *c*, and FIG. 1 *d*, in one illustrative exemplary embodiment, a card extraction apparatus 100 is disclosed, which has a proximate card end 101, a distal card end 103, an affixing element 102, and a tab member 104. The affixing element 102 is disposed at the proximate card end 101 of the card extraction apparatus 100 and is adapted to affix the card extraction apparatus 100 to a card (not shown) in a variety of different configurations, as will be disclosed herein. The tab member 104 is disposed at the distal card end 103 of the card extraction apparatus 100 and has a tab width and a tab length, which operate to define an area 106 within which an identification portion 110 may optionally be disposed. The optional identification portion 110 may be predetermined or user customizable. Moreover, in some embodiments, a Radio Frequency Identification Tag ("RFID tag") may optionally be disposed in or near this area.

In one embodiment, the affixing element 102 further comprises an adhesive compound, disposed upon a first surface 102*a*, and which comes into intimate contact with a first side of the card stored in the card storage apparatus. In this embodiment, a second surface 102*b* has no adhesive compound. Materials from which the adhesive compound may be manufactured include natural or synthetic adhesives.

In one illustrative exemplary situation, when a user desires to retrieve a credit card and/or identification from her wallet during the course of a financial transaction, such a card can be substantially wedged into the wallet making it extremely difficult to retrieve. Because typical wallets contain slots for cards, which are spaced closely and may contain more than one card, this problem is compounded. Furthermore, often credit cards, debit cards, and other such financial transaction instruments have an embossing which further operates to wedge a card into a wallet. A specifically targeted force applied to a relatively small fraction of the card may be required to successfully remove the card. The user's fingers may not be strong enough to pull the card out of the slot. Employing a card extraction apparatus of the present teachings to retrieve a wedged card from a wallet slot, a user grasps a tab member and applies a force perpendicular to a longitudinal axis of the wallet slot, thereby applying a removing force to the card in a manner facilitating removal of the card from the wallet slot, with significantly less force and potential to damage the card than previous solutions have presented.

In one embodiment, a hinge line 108, having a hinge axis substantially perpendicular to a longitudinal axis of the card extraction apparatus 100, functions to bisect a foldable portion of the tab member 104, the foldable portion comprising a covering portion and a covered portion. The covering portion may be defined between the hinge line 108 and a distal card end 103. The covered portion may be defined as an area 106, wherein an identification portion 110 may optionally be located. The identification portion 110 may be predetermined or customizable, as desired by a user. That is, the user's identifying mark, such as for example the user's initials, may be imprinted thereon the identification portion 110. In another embodiment, the identification portion is customizable by the user, such that the user may write her initials thereupon. After writing her initials, the user may then fold the covering portion, at the hinge line 108, down onto the covered portion. An affixing material, such as for example an adhesive material is disposed optionally on the covering portion and/or the covered portion. In one embodiment, the covering portion is transparent such that the identification portion 110 is visible therethrough.

In one embodiment, an RFID tag may be placed in or near the identification portion 110. The RFID tag may be either passive or active. A reader functions to read information from an RFID tag, such as for example positioning data. In one embodiment, a reader may be located within a user's reach, such as for example on a key chain. In this embodiment, if a card affixed to a card extraction apparatus 100 has been lost or misplaced, the reader provides positioning information, thereby allowing the user to find the lost card, such as for example a credit card lost in a large purse.

Figure 2A:
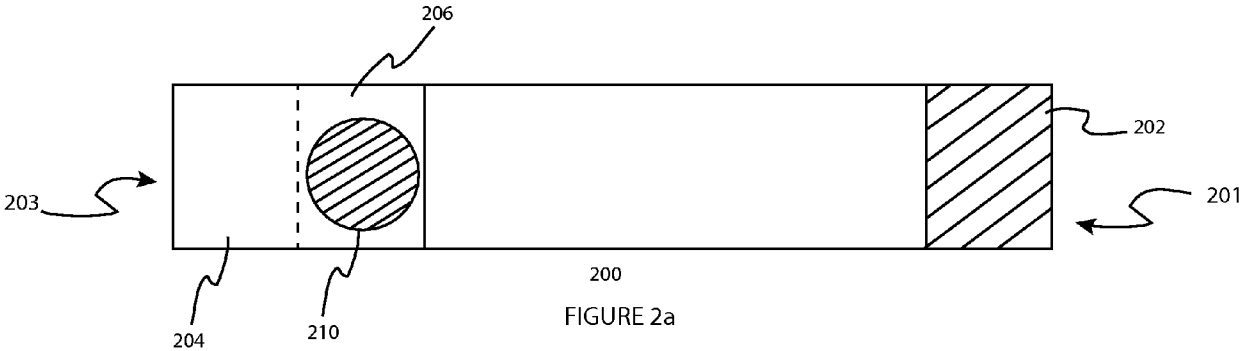
FIG. 2*a* illustrates a top plan view of a card extraction apparatus, according to one embodiment of the present teachings.
Figure 2B:
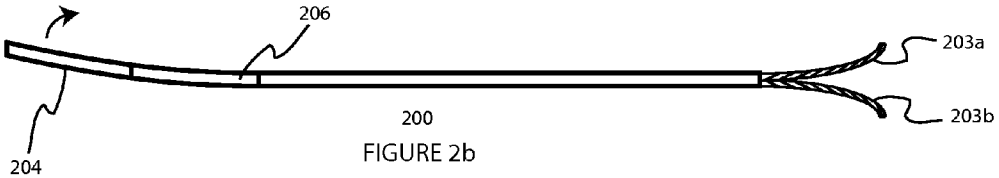
FIG. 2*b* illustrates a side plan view of a card extraction apparatus, according to one embodiment of the present teachings.
Figure 2C:
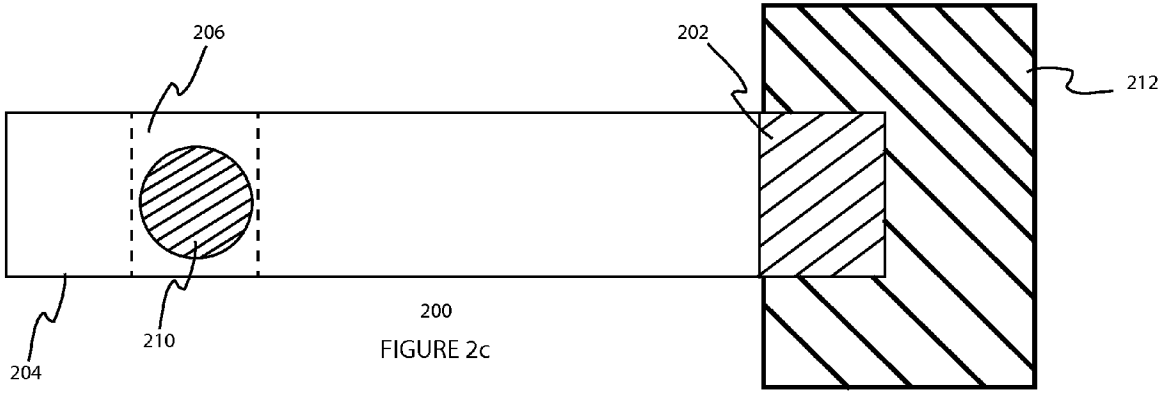
FIG. 2*c* illustrates a top plan view of a card extraction apparatus affixed to a card, according to one embodiment of the present teachings.

Referring now to FIG. 2*a*, FIG. 2*b*, FIG. 2*c*, in one illustrative exemplary embodiment, a card extraction apparatus 200 is disclosed, which has a proximate card end 201, a distal card end 203, an affixing element 202, and a tab member 204. The affixing element 202 is disposed at the proximate card end 201 of the card extraction apparatus 200 and is adapted to affix the card extraction apparatus 200 to a card 212. The tab member 204 is disposed at the distal card end 203 of the card extraction apparatus 200 and has a tab width and a tab length, which operate to define an area 206 within which an identification portion 210 may optionally be disposed. The optional identification portion 210 may be predetermined or user customizable. Moreover, in some embodiments, a Radio Frequency Identification Tag ("RFID tag") may optionally be disposed in or near this area.

FIG. 2*b* illustrates a side plan view of the card extraction apparatus 200. An adhesive may be disposed upon a first surface 203*a*, which will make intimate contact with a first side of a card 212. An adhesive may also be disposed upon a second surface 203*b*, which will make intimate contact with a second side of the card 212, as illustrated in FIG. 2*c*. In this manner, the card extraction apparatus 200 effectively has two sides of physical contact with the card 212.

Figures 3A, 3B, 3C:
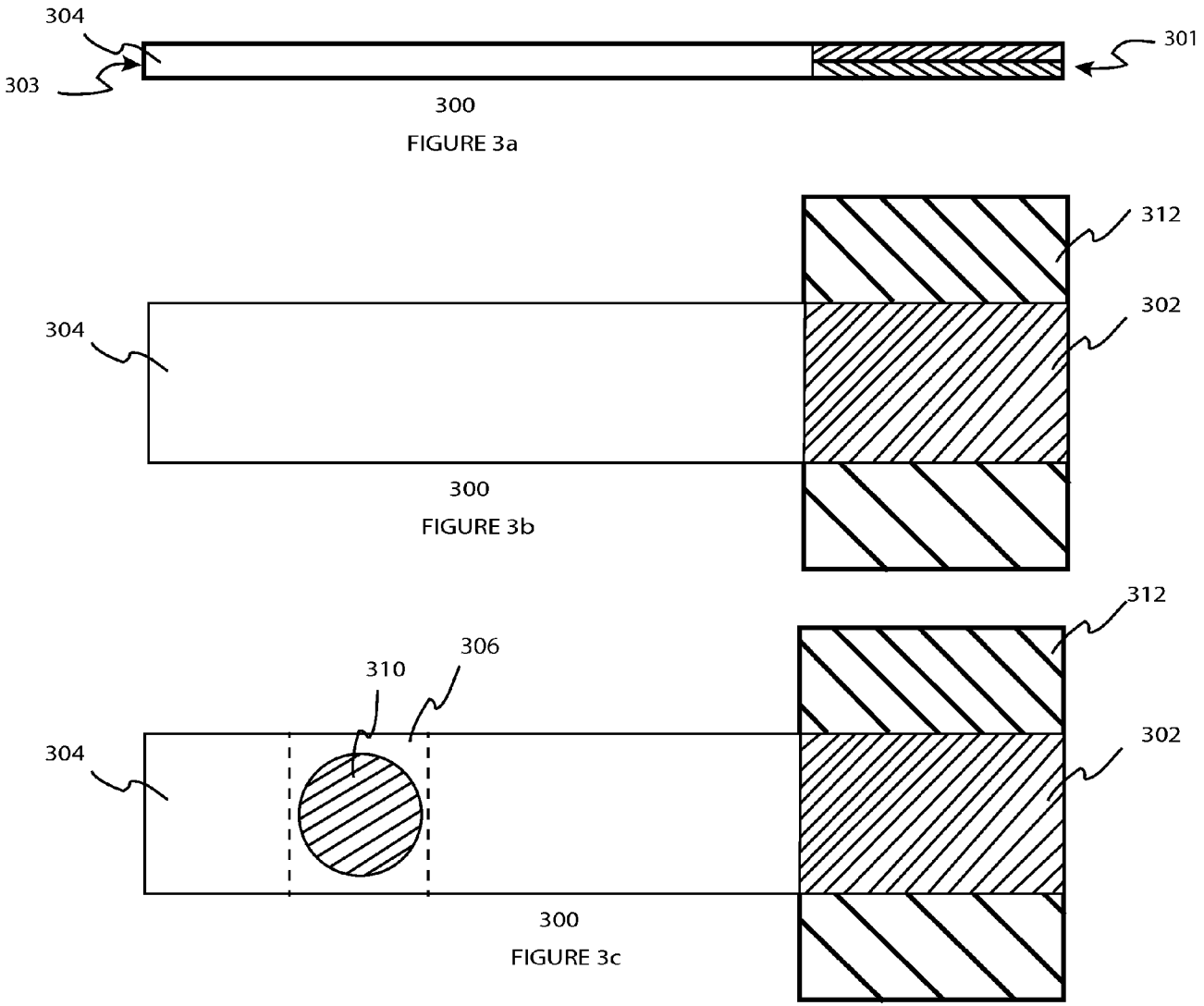
FIG. 3*a* illustrates a side plan view of a card extraction apparatus, according to one embodiment of the present teachings.
FIG. 3*b* illustrates a first top plan view of a card extraction apparatus affixed to a card, according to one embodiment of the present teachings.
FIG. 3*c* illustrates a second top plan view of a card extraction apparatus affixed to a card, according to one embodiment of the present teachings.

Referring now to FIG. 3*a*, FIG. 3*b*, FIG. 3*c*, in one illustrative exemplary embodiment, a card extraction apparatus 300 is disclosed, which has a proximate card end 301, a distal card end 303, an affixing element 302, and a tab member 304. The affixing element 302 is disposed at the proximate card end 301 of the card extraction apparatus 300 and is adapted to affix the card extraction apparatus 300 to a card 312. The tab member 304 is disposed at the distal card end 303 of the card extraction apparatus 300 and has a tab width and a tab length, which operate to define an area 306 within which an identification portion 310 may optionally be disposed. The optional identification portion 310 may be predetermined or user customizable. Moreover, in some embodiments, a Radio Frequency Identification Tag ("RFID tag") may optionally be disposed in or near this area.

FIG. 3*b* illustrates a side plan view of the card extraction apparatus 300. The affixing element 302 forms a continuous loop, through which the card 312 may be inserted. The card 312 is thereby securely affixed to the card extraction apparatus 300.

Figures 4A, 4B, 4C:
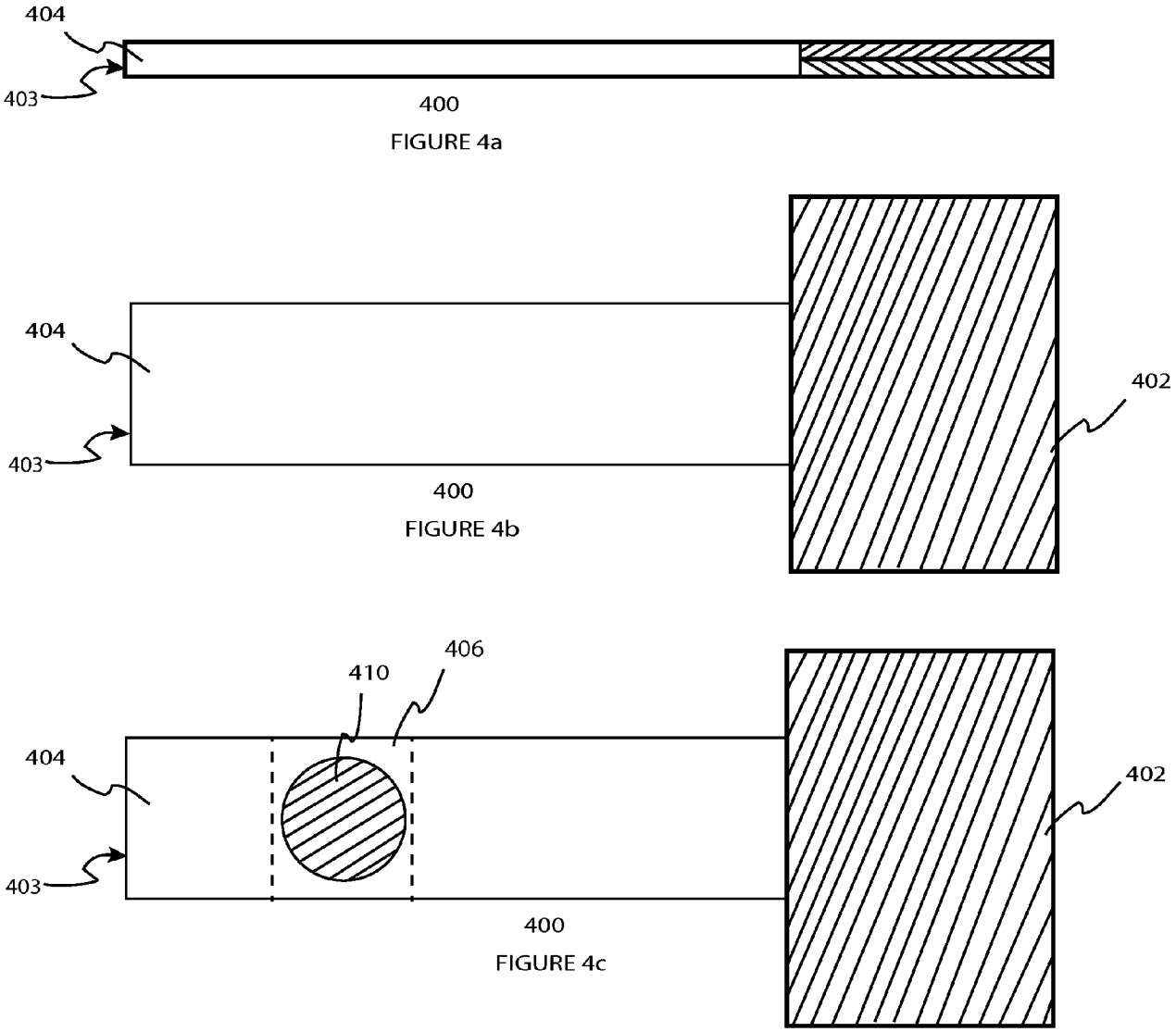
FIG. 4*a* illustrates a side plan view of a card extraction apparatus, according to one embodiment of the present teachings.
FIG. 4*b* illustrates a first top plan view of a card extraction apparatus, according to one embodiment of the present teachings.
FIG. 4*c* illustrates a second top plan view of a card extraction apparatus, according to one embodiment of the present teachings.

Referring now to FIG. 4*a*, FIG. 4*b*, FIG. 4*c*, in one illustrative exemplary embodiment, a card extraction apparatus 400 is disclosed, which has a proximate card end 401, a distal card end 403, an affixing element 402, and a tab member 404. The affixing element 402 is disposed at the proximate card end 401 of the card extraction apparatus 400 and is adapted to affix the card extraction apparatus 400 to a card. The tab member 404 is disposed at the distal card end 403 of the card extraction apparatus 400 and has a tab width and a tab length, which operate to define an area 406 within which an identification portion 410 may optionally be disposed. The optional identification portion 410 may be predetermined or user customizable. Moreover, in some embodiments, a Radio Frequency Identification Tag ("RFID tag") may optionally be disposed in or near this area.

In one embodiment, the affixing element 402 provides a complete sheath for the card. That is, the card is inserted into affixing element 402 as a sleeve or sheath. In one alternate embodiment, the affixing element is composed of materials protecting a card magnetic strip from becoming demagnetized. In this embodiment, the affixing element 402 is composed of a material such as Tyvek plastic or paper.

The foregoing description illustrates exemplary implementations, and novel features, of aspects of an apparatus for extracting a card from a card storage device. Alternative implementations are suggested, but it is impractical to list all alternative implementations of the present teachings. Therefore, the scope of the presented disclosure should be determined only by reference to the appended claims, and should not be limited by features illustrated in the foregoing description except insofar as such limitation is recited in an appended claim.

While the above description has pointed out novel features of the present disclosure as applied to various embodiments, the skilled person will understand that various omissions, substitutions, permutations, and changes in the form and details of the present teachings illustrated may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprising".

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as"and/or" unless expressly stated otherwise. Furthermore, although items, elements or components of the disclosed method and apparatus may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A card extraction apparatus, having a proximate card end and a distal card end, the card extraction apparatus is adapted for facilitating a user extracting a card stored in a card storage apparatus, comprising:

a. an adhesive compound disposed upon a first surface in intimate contact with a first side of the card stored in the card storage apparatus, disposed at the proximate card end of the card extraction apparatus, an adhesive compound disposed upon a second surface in intimate contact with a second side of the card stored in the card storage apparatus, wherein the adhesive compound is adapted to affix the card extraction apparatus to the stored card, and;

b. a tab member, disposed at the distal card end of the card extraction apparatus, wherein the tab member has a tab width and a tab length, wherein the tab member further comprises a foldable portion, adapted for customized identification marking by the user, wherein the foldable portion comprises a covering portion and a covered portion separated by a hinge line, wherein the hinge line is adapted to hinge along the hinge line, wherein the covering portion is folded over the covered portion.

2. The card extraction apparatus of claim 1, further comprising, wherein the covered portion comprises an identification marking portion.

3. A method for extracting a card from a card storage apparatus, comprising:

a. affixing an affixing element to the card at a proximate card end;

b. providing a tab member, operatively coupled to the affixing element at a distal card end, wherein the tab member has a tab width and a tab length;

c. applying a card extracting force, applied in a direction opposite to the card storage apparatus;

d. providing an identification portion upon the tab member, and;

e. providing a foldable portion, adapted for customized identification marking by the user, wherein the foldable portion comprises a covering portion and a covered portion separated by a hinge line.

* * * * *